US005725395A

United States Patent [19]

Lee

[11] Patent Number: 5,725,395

[45] Date of Patent: Mar. 10, 1998

[54] UNIVERSAL SERIAL BUS CONNECTOR

[76] Inventor: Su-Lan Yang Lee, 4th Floor, No. 506-2, Yuan-Shan Road, Chung Ho City, Taipei Hsien, Taiwan

[21] Appl. No.: 695,559

[22] Filed: Aug. 12, 1996

[51] Int. Cl.[6] ..... H01R 13/648

[52] U.S. Cl. ..... 439/610; 439/108

[58] Field of Search ..... 439/607–610, 439/101, 108

[56] References Cited

U.S. PATENT DOCUMENTS

| | | | |
|---|---|---|---|
| 5,052,949 | 10/1991 | Lopata et al. | 439/610 |
| 5,199,903 | 4/1993 | Asick et al. | 439/610 |
| 5,267,882 | 12/1993 | Davis | 439/610 |
| 5,518,421 | 5/1996 | Davis | 439/610 |

*Primary Examiner*—Hien Vu

[57] ABSTRACT

A universal serial bus connector includes a plastic housing sandwiched between a lower casing and an upper casing. The lower casing has a hollow cartridge in its front section for accommodating the plastic housing. The upper casing is placed upon the lower casing to close the opening of the hollow cartridge. A stopper plate upwardly projecting from the bottom of the cartridge and a stopper plate downwardly projecting from a face board of the upper casing prevent inadvertent displacement of the plastic housing. A resilient sensing protuberance projects from the bottom of the cartridge to engage a dent on the bottom of the plastic housing and to generate a distinct sound which indicates that the plastic housing is in its proper position. Projecting plates of tapered slope walls of the upper casing engage corresponding slits of the base board of the lower casing, facilitating in keeping the lower and upper cases in proper mutual disposition and preventing the connector from being deformed by high pressure during formation of the external insulative layer. A clip lever formed on a cable seat of the upper casing tightly clips a ground lead to the connector.

2 Claims, 5 Drawing Sheets

UNIVERSAL SERIAL BUS CONNECTOR

BACKGROUND OF THE INVENTION

The present invention relates to a universal serial bus connector including a lower casing and an upper casing which are securely engaged with each other to firmly enclose a plastic housing in which multiple terminals are collected. A portion of the plastic housing projects out of the cartridge of the lower casing so that an operator can push the plastic housing inward without using any tool or holding the cable section of the plastic housing. Therefore, the plastic housing can be easily installed in its proper position without damaging the terminals due to over-forcing.

FIGS. 1 and 2 show a conventional universal serial bus connector which is composed of a lower casing 41, an upper casing 42 and a plastic terminal housing 43 sandwiched between the lower and upper casings 41, 42. The lower casing 41 has a cartridge 44 at front end thereof for placing the plastic terminal housing 43 therein. Two latch holes 45 are formed on upper side of the cartridge 44 near an opening 48 thereof. A clip seat 46 extends from a rear end of the cartridge 44. The front end of the upper casing 42 has two projecting stopper plates 47 for fitting into the latch holes 45 of the lower casing 41, whereby the upper casing is assembled with the lower casing so as to firmly clamp the plastic terminal housing 43. Several shortcomings exist in the above serial bus connector as follows:

1. When assembled, the plastic terminal housing 43 is first pushed through the opening 48 into the cartridge 44 of the lower casing 41. When the rear end face 49 of the plastic terminal housing 43 is flush with the opening 48 of the cartridge 44, the operator will be unable to further push the housing 43 into the cartridge 44. In order to solve this problem, the operator must hold the cable section 50 connected at the rear end of the housing 43 or use other tool to further push the housing 43 into the cartridge 44 so as to prevent the housing 43 from blocking the latch holes 45 of the lower casing 41. Accordingly, the two stopper plates 47 of the upper casing 42 can be smoothly inserted into the latch holes 45 of the cartridge 44 so as to stop the housing 43 from rearward sliding. During the pushing operation, the cable is apt to be pulled apart and the housing can be hardly pushed to its true position. Such assembling procedure is quite troublesome and will lead to increment of the cost.
2. The upper and lower casings, 42, 41 lack any other locking means so that when the upper and lower casings 42, 41 are assembled with each other, the cable section 50 of the housing 43 often abuts against the upper and lower casings 42, 41 and makes the upper and lower casings 42, 41 unable to tightly associate with each other as shown in FIG. 2. Therefore, the operator must continuously depress the upper casing 42 to planely attach to the lower casing 41 so that the two lateral clip plates 51 of the clip seat 46 of the lower casing 41 can be bent inward to clamp the upper casing 42. Such assembling procedure is quite complicated and inconvenient to the operator. Moreover, continuously pressing the upper casing with hand for riveting operation, the operator's hand is very close to the riveting machine and apt to be injured thereby.
3. The cartridge 44 lacks any inner locating mechanism so that after the housing 43 is inserted into the cartridge 44, the housing 43 is very likely to be rearwardly extracted from the cartridge 44 due to pulling action of the cable section 50. This makes it necessary to push the housing 43 into the cartridge 44 again.
4. Each lateral wall 52 of the upper casing 42 is formed from a single board material by bending. After the upper and lower casing 42, 41 are assembled, the assembly is wrapped by an outer insulative layer (not shown). Due to very high injection molding pressure, the lateral walls 52 of the upper casing 42 are often forced to be displaced outward and are therefore, exposed outside the outer insulative layer, thereby forming a defective product.
5. No ground lead fastening means is provided so that the ground lead must be additionally soldered. This causes great inconvenience.

SUMMARY OF THE INVENTION

It is therefore a primary object of the present invention to provide an improved universal serial bus connector so as to achieve the following effects:

1. The plastic housing is inserted into the cartridge of the lower casing without using any tool for holding the cable section of the plastic housing. Therefore, any damage or deformation of the terminals collected in the plastic housing due to over-forcing can be avoided.
2. A sensing protuberance is disposed in the cartridge, so that once the plastic housing has been located in its proper position, a sound indicative of engaging is emitted to enable the operator to know that the plastic housing is located in its proper position. Moreover, the plastic housing is prevented from being extracted from the cartridge due to pulling action of the cable.
3. The upper and lower casings are easily and securely engaged with each other to facilitate the assembling procedure and in further use of the connector.
4. The lateral walls of the upper and lower casings are all firmly latched with each other so that when the assembly is wrapped by the outer insulative layer by injection molding, the lateral walls are prevented from being stretched open so as to ensure the quality of the product.

The present invention can be best understood through the following description and accompanying drawing, wherein:

DETAILED DESCRIPTION OF THE PREFERRED EMBODIMENT

Figure 1:
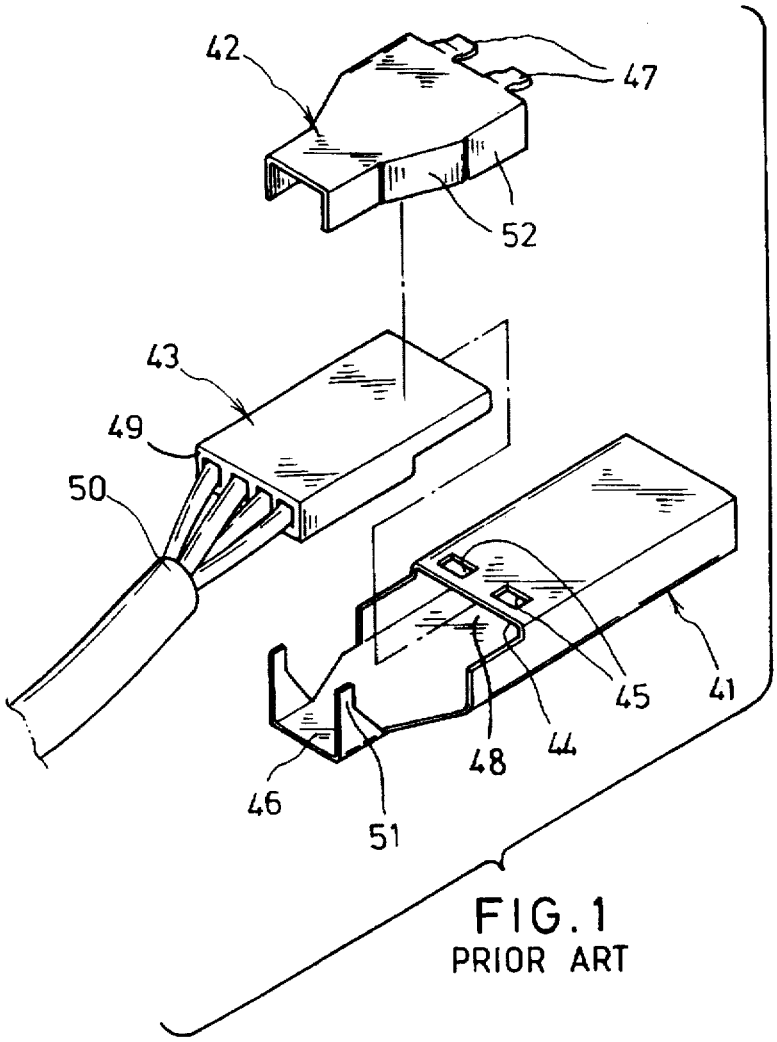
FIG. 1 PRIOR ART
FIG. 1 is a perspective exploded view of a conventional universal serial bus connector.
Figure 2:
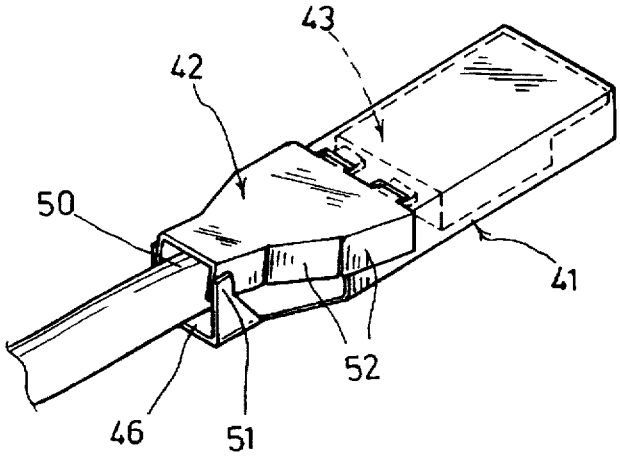
FIG. 2 PRIOR ART
FIG. 2 is a perspective assembled view according to FIG. 1.
Figure 3:
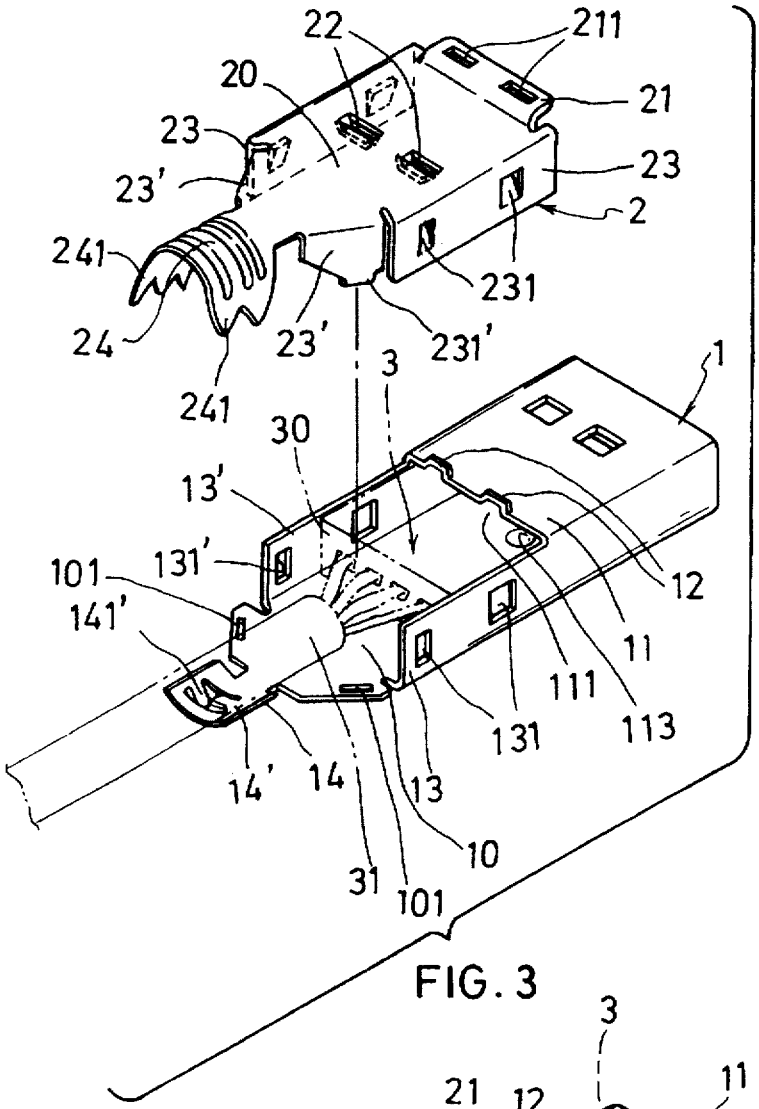
FIG. 3 is a perspective exploded view of the connector according to the present invention.

Referring to FIGS. 3 to 11, a universal serial bus connector of the present invention includes a lower casing 1, and upper casing 2 and a plastic housing 3 clamped between the upper and lower casings 2, 1. The assembly of the upper and lower casings is wrapped by an outer insulative layer 4 by means of injection molding so as to form the connector.

The lower casing 1 includes: a hollow cartridge 11 lengthwisely formed at the front end of the lower casing 1. At the rear end thereof, the cartridge 11 has an entrance 111 for placing the plastic housing 3 therethrough into the cartridge 11. At least one lug 12 projects upwardly from the upper side of the cartridge 11. Two lateral walls 13, 13', respectively, rearwardly extend at two sides of the entrance 111 of the cartridge 11. Each lateral wall 13, 13' is provided with at least one latch hole 131, 131'. A cable seat 14 rearwardly extends from a rear end of the base board 10 of the lower casing 1 so that the cable section 31 of the plastic housing 3 is supported thereon.

The cartridge 11 includes: at least one stopper plate 112 projecting from the inner side of the front end of the cartridge 11 in front of the plastic housing 3 for preventing the plastic housing 3 from further sliding forward; and a sensing protuberance 113 projecting from the inner wall of the cartridge 11. When the plastic housing 3 is placed into the cartridge 11 with its front end abutting against the stopper plate 112, the sensing protuberance 113 is snugly engaged into a dent 32 of the plastic housing 3 to emit an engaging sound. This sound "informs" the operator that the plastic housing 3 is located in its proper position, so that the operator does not need to push the plastic housing 3 further inward. Therefore, any damage of the respective parts due to over-forcing can be avoided. Also, the plastic housing 3 is prevented from rearward displacement.

The entrance 111 of the cartridge 11 is positioned in front of the rear end face 30 of the plastic housing 3 located in the cartridge 11 or is flush with the rear end face 30, so that a rear section of the plastic housing 3 is exposed outside the cartridge 11 or aligned with the entrance 111, and, therefore, is always accessible. Accordingly, the operator can push the plastic housing 3 inward without using any tool or holding the cable section 31. Therefore, the plastic housing 3 can be easily installed without damage of the terminals connected with the cable section 31 due to over-forcing.

As shown in FIGS. 4 to 6, 10A and 11, the cable seat 14 of the lower casing 1 is punched with a ground lead fixing section 14' having a clip lever 141' cooperating with a clip seat 24 of the upper casing 2 for clipping a ground lead 31'. The ground lead is passed through the upper edge of the clip lever 141', so that once the clip seat 24 has been hooked, the clip lever 141' is simultaneously pushed upward so as to tightly clip the ground lead 31' instead of the conventional soldering for securing the ground lead to the connector.

Figure 8:
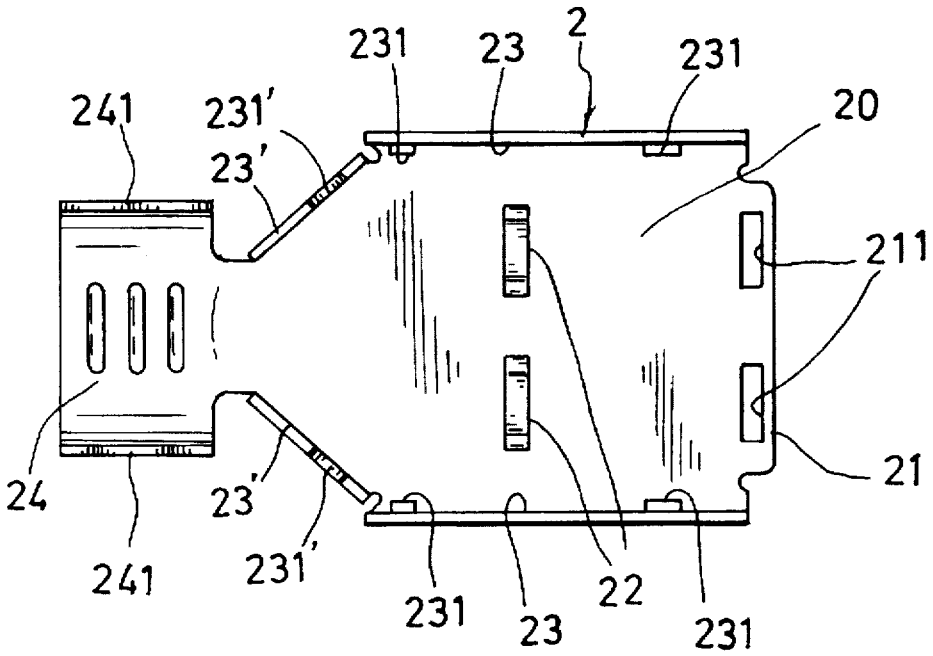
FIG. 8 is a bottom view of the upper casing of the connector of the present invention.
Figure 9:
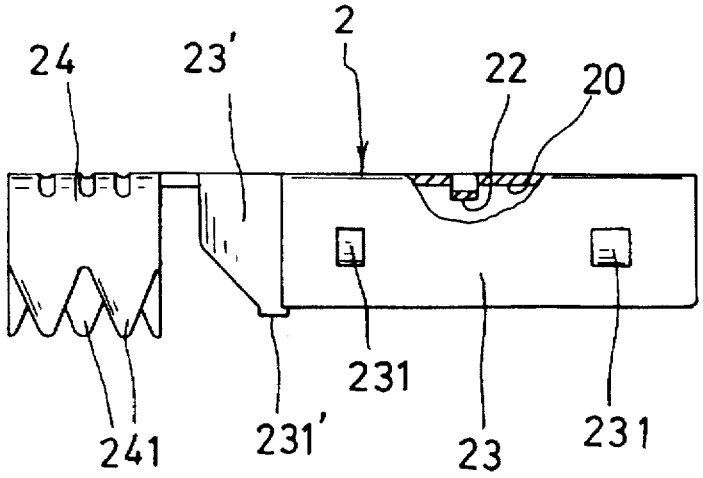
FIG. 9 is a side partially sectional view of the upper casing of the connector of the present invention.
Figure 10:
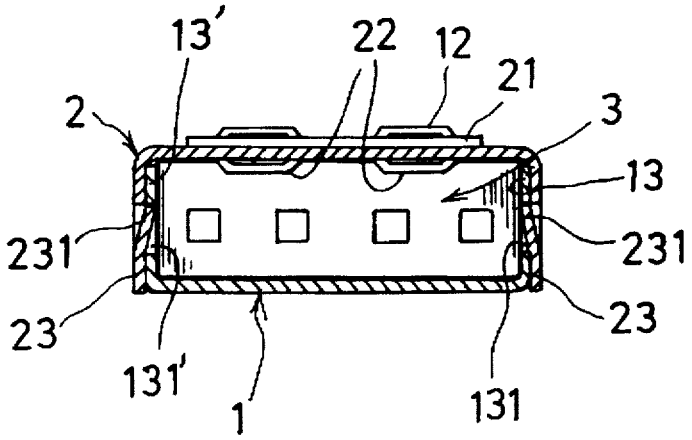
FIG. 10 is a sectional view taken along line 10—10 of FIG. 4.
Figure 10A:
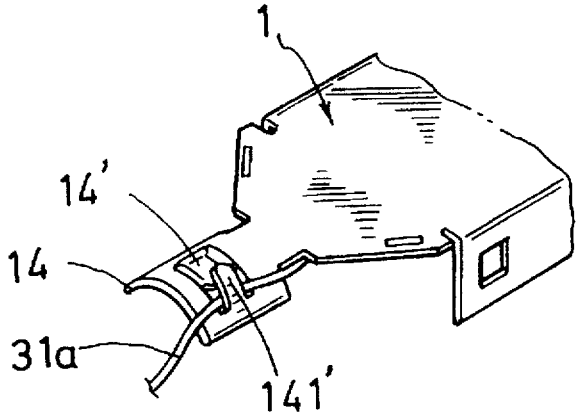
FIG. 10A is a perspective bottom view showing that the ground lead is clipped by the clip lever of the lower casing of the connector of the present invention.
Figure 11:
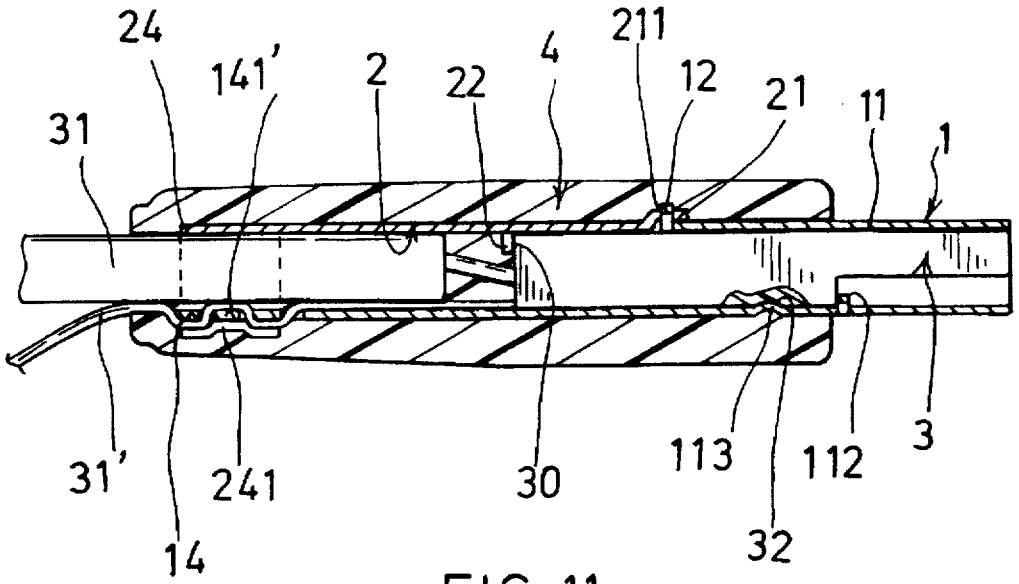
FIG. 11 is a sectional view showing that the assembly of the upper and lower casings is wrapped by an outer insulative layer.

Referring to FIGS. 8 and 9, the upper casing 2 includes: a face board 20, at least one coupling latch plate 21 projecting from the front end of the upper casing 2, at least one through hole 211 corresponding to and fitted with the lug 12 of the lower casing formed on the plate 21; at least one stopper plate 22 downwardly projecting from the face board 20 of the upper casing 2 to abut against the rear end face 30 of the plastic housing 3*j* two lateral walls 23, respectively, downwardly extending from two sides of the upper casing 2, each lateral wall 23 being formed with at least one latch hook 231 corresponding to and fitted with the latch hole 131, 131' of the lower casing 1 (as shown in FIG. 10); and a clip seat 24 extending from the rear end of the face board 20 and having two clip plates 241 downwardly extending from two sides of the clip seat 24.

Figure 4:
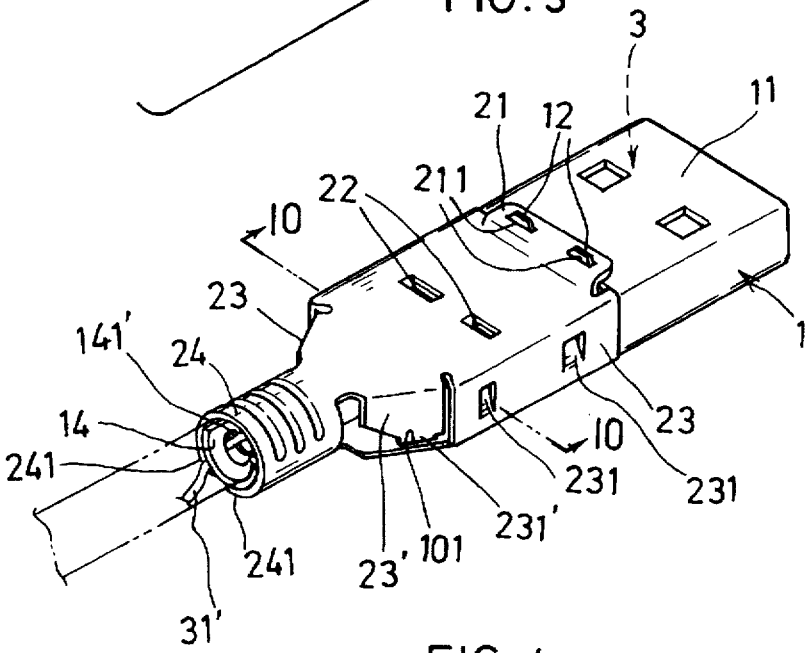
FIG. 4 is a perspective assembled view of the connector according to FIG. 3.
Figure 5:
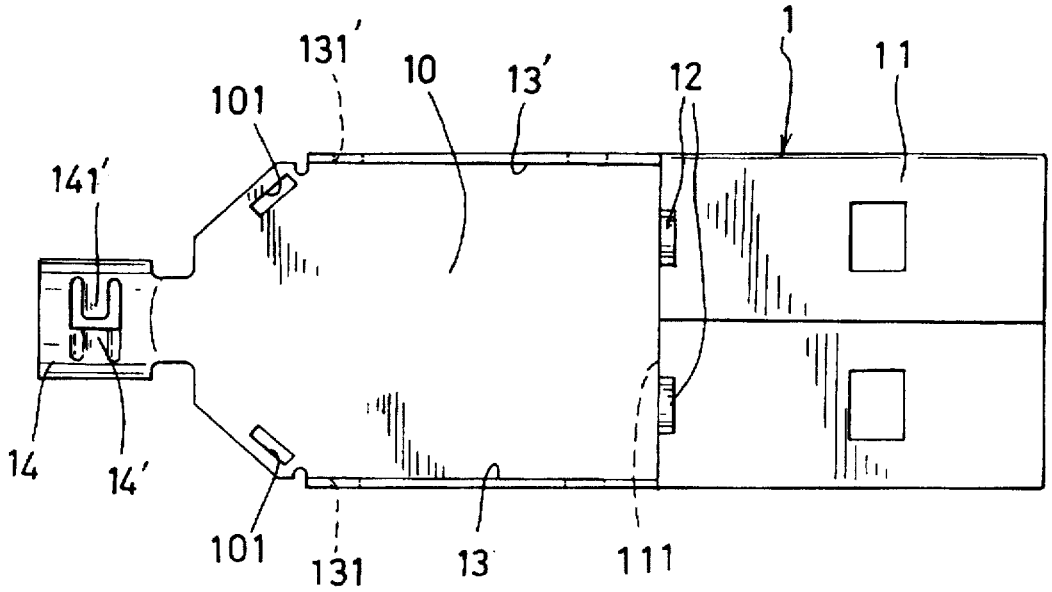
FIG. 5 is a top view of the lower casing of the connector of the present invention.
Figure 6:
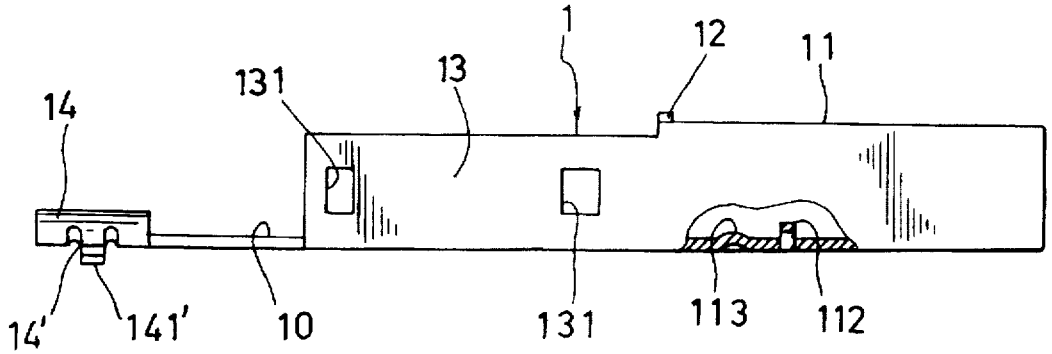
FIG. 6 is a slide partially sectional view of the lower casing of the connector of the present invention.
Figure 7:
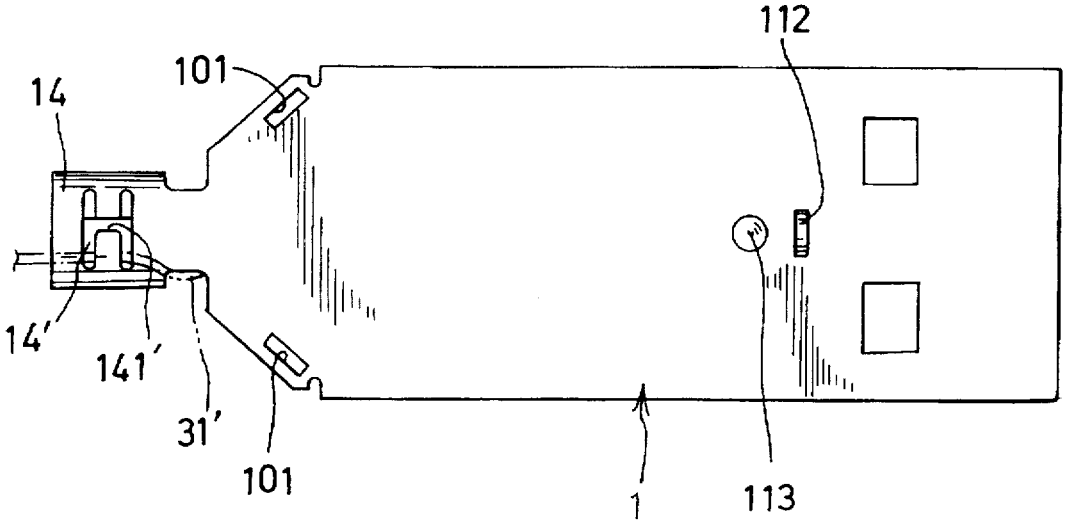
FIG. 7 is a bottom view of the lower casing of the connector of the present invention.

Two rearward tapered slope side walls 23' are formed on two sides of the rear section of the face board 20 of the upper casing 2. The bottom end of each slope side wall 23' is provided with a projecting plate 231' so that when the upper and lower casings 2, 1 are engaged with each other, the projecting plates 231' are inserted into the slits 101 of the base board 10 of the lower casing 1, as shown in FIG. 4. Therefore, the two slope side walls 23' are securely prevented from being stretched outwardly. Accordingly, when the upper and lower casings 2, 1 are wrapped by the insulative layer 4 by injection molding, the slope side walls 23' are protected from being stretched open by the high temperature and high pressure insulative material infiltrating through the clearance between the upper and lower casings 2, 1. Therefore, no defective product will be produced.

When assembled, the plastic housing 3, in which the terminals are collected is first pushed through the entrance 111 into the cartridge 11 of the lower casing 1. When the front end of the plastic housing 3 abuts against the stopper plate 112 inside the cartridge 11, the sensing protuberance 113 is snugly engaged into the dent 32 of the plastic housing 3 to emit an engaging sound. This sound "informs" the operator that the plastic housing 3 is located in its proper position. The ground lead 31' is positioned at the bottom end of the clip lever 141'. Thereafter, the lug 12 of the lower casing 1 is fitted into the through hole 211 of the coupling latch plate 21 of the upper casing 2 and the latch hooks 231 of the lateral walls 23 of the upper casing 2 are latched in the latch holes 131, 131' of the lateral walls 13, 13' of the lower casing 1, so that the upper casing 2 is securely engaged with the rear section of the lower casing 1 so as to enclose the plastic housing 3 and the cable section 31 therein. Also, the stopper plate 22 inside the upper casing 2 abuts against the rear end face 30 of the plastic housing 3, making the same firmly located between the stopper plate 112 and the stopper plate 22. The upper casing 2 is securely engaged with the lower casing 1 without being upwardly deflected so that the operator can directly bend the clip plates 241 of the clip seat 24 of the upper casing in order to clamp the cable section 31 in cooperation with the cable seat 14 of the lower casing 1. Simultaneously, the ground lead 31' is tightly clamped by the clip plates 241 and the clip lever 141' to complete the assembly of the upper and lower casings 2, 1.

According to the above arrangements, the universal serial bus connector of the present invention has the following advantages:

1. When the plastic housing 3 is inserted into the cartridge 11 of the lower casing 1, the sensing protuberance 113 of the cartridge enables the operator to know whether the plastic housing is located in its proper position.
2. The installation of the plastic housing can be easily and quickly completed without using any tool.
3. The upper and lower casings are securely engaged with each other to facilitate in further use of the connector.
4. The lateral walls of the upper and lower casings are all firmly latched with each other so that when the assembly is wrapped by the outer insulative layer by injection molding, the lateral walls are prevented from being stretched open to form defective product.

5. The ground lead is conveniently and firmly clipped and secured to the connector by the clip structure without any soldering operation.

It is to be understood that the above description and drawings are only used for illustrating one embodiment of the present invention, not intended to limit the scope thereof. Any variation and derivation from the above description and drawings should be included in the scope of the present invention.

What is claimed is:

1. A universal serial bus connector, comprising:

a lower casing having a hollow cartridge provided with an entrance thereto, an upper casing adapted to be disposed on said lower casing, thereby closing said entrance into the cartridge, and a plastic housing sandwiched between said lower and upper casings, a cable being terminated within said plastic housing;

said lower casing comprising:

a base board, a cable seat at a rear end thereof, the cable seat having a ground lead fixing section, a clip lever being formed thereon, a pair of first lateral walls, each extending upwardly along a respective side of the base board, at least one latch hole being disposed on each of said first lateral walls, an upper side of the cartridge extending between said first lateral walls and spaced from the base board, thereby providing room for said plastic housing therebetween, at least one lug upwardly extending from the upper side of the cartridge substantially at the entrance thereto, and a pair of slits on said base board, each slit being positioned between a respective one of said first lateral walls and said cable seat;

said upper casing comprising:

a face board, a coupling latch plate at a front end of the face board, said coupling latch plate having at least one through hole engaging said at least one lug on the upper side of the cartridge, a clip seat extending from a rear end of the face board and cooperating with said clip lever for clipping the ground lead, a pair of second lateral walls, each extending downwardly along a respective side of the face board, at least one latch hook extending inwardly from each of said second lateral walls and engaging said at least one latch hole on a respective first lateral wall of the lower casing, and a pair of slope side walls, each extending downwardly from the face board between a respective one of said second lateral walls and said clip seat, a projecting plate being formed at a lower edge of each of said slope side walls, said projecting plate engaging a respective one of said slits on the base board of the lower casing;

a first stopper plate projecting downwardly from the face board of the upper casing, a second stopper plate projecting upwardly from the base board of the lower casing, said first stopper plate engaging a rear end of said plastic housing, said second stopper plate engaging a front end of said plastic housing, thereby preventing said plastic housing from being inadvertently displaced from a proper position thereof within said lower and upper casings; and said base board of the lower casing further having a sensing protuberance upwardly extending therefrom, and said plastic housing further having a dent formed on a bottom thereof and engaging said sensing protuberance, once said plastic housing has been disposed in said proper position thereof.

2. The universal serial bus connector of claim 1, further including an outer insulated layer wrapping assembled said upper and lower casings and said plastic housing sandwiched therebetween.

* * * * *